United States Patent [19]

Denning

[11] Patent Number: 4,856,930

[45] Date of Patent: Aug. 15, 1989

[54] PAVEMENT AND METHODS FOR PRODUCING AND RESURFACING PAVEMENT

[76] Inventor: Gary R. Denning, P.O. Box 497, Payne, Ohio 45880

[21] Appl. No.: 274,710

[22] Filed: Nov. 18, 1988

Related U.S. Application Data

[63] Continuation of Ser. No. 52,282, May 21, 1987, abandoned.

[51] Int. Cl.[4] ..... E01C 3/00; E01C 11/16

[52] U.S. Cl. ..... 404/31; 404/28; 404/70; 404/82

[58] Field of Search ..... 404/17, 18, 27, 28, 404/31, 43–45, 70, 75, 78, 82

[56] References Cited

U.S. PATENT DOCUMENTS

| | | | |
|---|---|---|---|
| 22,444 | 12/1958 | Montgomery | 404/18 |
| 1,225,055 | 5/1917 | Ransome | 404/70 |
| 2,000,978 | 5/1935 | Moseley | 404/17 |
| 2,078,485 | 4/1937 | Dunham | 404/31 |
| 2,242,559 | 5/1941 | Vissering | 404/27 |
| 2,259,374 | 10/1941 | Gramelspacher | 404/28 |
| 3,557,671 | 1/1971 | Vasiloff | 404/82 |
| 4,523,755 | 6/1985 | Turba | 404/31 |

FOREIGN PATENT DOCUMENTS

| | | | |
|---|---|---|---|
| 1138719 | 6/1957 | France | 404/70 |

*Primary Examiner*—Jerome W. Massie, IV
*Assistant Examiner*—John F. Letchford
*Attorney, Agent, or Firm*—Lundy and Walker

[57] ABSTRACT

A pavement having one or more surface layers overlaying one or move base layers disposed on a subgrade with a rigid base layer interposed therebetween. The base layers are composed of paving material. The surface layers are composed of flexible paving material. The bearing member separates the surface layers from the base layers and has about the same longitudinal and transverse dimensions as the surface layers. The bearing member is composed of a substantially aggregate-free or aggregate free material. The bearing member is sufficiently rigid to at least generally prevent any surface layers from conforming, during the useful life of the base layers, to irregularities of the base layers and to move with the surface layers as a unit in response to movement of the base layers.

16 Claims, 1 Drawing Sheet

PAVEMENT AND METHODS FOR PRODUCING AND RESURFACING PAVEMENT

This is a continuation of co-pending application Ser. No. 052,282 filed on May 21, 1987, now abandoned.

BACKGROUND OF THE INVENTION

This invention relates to a method for producing pavement, a method for resurfacing pavement, and a pavement and more particularly to pavements consisting of a composite of different materials and to methods for producing and resurfacing the same.

Pavements consist of one or more layers of selected material disposed on a subgrade, which is underlying soil or other geologic structure. A subgrade may be tamped or otherwise treated or may be in its natural state. Overlaying the subgrade, there is generally a base which serves to distribute the stresses from vehicle loads acting on the pavement in order to prevent damage to the subgrade. The base is generally highly stable and dense. Over the base is a surface course of paving material which is directly exposed to vehicle action.

Paving materials, as used for surface courses and bases, may be roughly divided into flexible materials and rigid materials. Rigid materials, used as surface course or base, may demonstrate some flexibility, but are resilient and can bridge small irregularities of a base or subgrade. Flexible materials used as a base or surface course do not have the ability to bridge irregularities and, over time, the flexible material will conform to the shape of the underlying base or subgrade, including the irregularities. There are intermediate types of paving material between flexible and rigid, and beyond a certain size irregularity, rigid pavement will not bridge, but will rather break down resulting in exposure of the irregularity and loss of serviceability of the pavement.

Numerous shortcomings exist in previous pavements and methods of producing and resurfacing pavements. Concrete paving materials provide rigid pavements, but have problems of surface smoothness due to cracking and to joints required to compensate for expansion and contraction. Concrete pavements are also subject to thermal warping and resulting stresses and damage from temperature inequalities within the pavement. Bituminous pavements can be formulated to be flexible and not require joints, however, such pavements suffer from the shortcoming, with usage, of reflecting distortions or displacements of the base. Composite pavements with, for example, a flexible bituminous layer over concrete tend to combine shortcomings of the paving materials used. Composite pavements are generally used for resurfacing as opposed to new pavements, and may require extensive preparation of features such as joints and cracks before a flexible surface course can be placed over worn pavement.

It is therefore highly desirable to provide an improved pavement and improved methods for producing and resurfacing pavement.

It is also highly desirable to provide an improved pavement and improved methods for producing and resurfacing pavement in which the flexible surface layers of paving material will not conform over time to irregularities in underlying base layers.

It is also highly desirable to provide an improved pavement and improved methods for producing and resurfacing pavement in which surface layers are kept separated from base layers.

It is also highly desirable to provide an improved pavement and improved methods for producing and resurfacing pavement in which joints and cracks in worn concrete pavement base layers are not extensively repaired.

It is also highly desirable to provide an improved pavement and improved methods for producing and resurfacing pavement in which plates are joined together edge to edge to form a heat conductive bearing member, which is at least substantially continuous in transverse and longitudinal directions.

It is also highly desirable to provide an improved pavement and improved methods for producing and resurfacing pavement in which a bearing member can guide a mechanism removing surface layers of paving materials.

It is also highly desirable to provide an improved pavement, and improved methods for producing and resurfacing pavement, which combine all of the above desired features.

SUMMARY OF THE INVENTION

It is therefore an object of this invention to provide an improved pavement, and improved methods for producing and resurfacing pavement.

It is also an object to provide an improved pavement and improved methods for producing and resurfacing pavement in which the flexible surface layers of paving material will not conform over time to irregularities in underlying base layers.

It is also an object to provide an improved pavement and improved methods for producing and resurfacing pavement in which surface layers are kept separated from base layers.

It is also an object to provide an improved pavement, and improved methods for producing and resurfacing pavement in which joints and cracks in worn concrete pavement base layers are not extensively repaired.

It is also an object to provide an improved pavement and improved methods for producing and resurfacing pavement in which plates are joined together edge to edge to form a heat conductive bearing member, which is at least substantially continuous in transverse and longitudinal directions.

It is also an object to provide an improved pavement and improved methods for producing and resurfacing pavement in which a bearing member can guide a mechanism removing surface layers of paving materials.

It is also an object to provide an improved pavement and improved methods for producing and resurfacing pavement which combine all of the above desired features.

In the broader aspects of this invention there is provided a method for producing pavement, a pavement having one or more surface layers overlaying one or more base layers disposed on a subgrade with a rigid base layer interposed therebetween. The base layers are composed of paving material. The surface layers are composed of flexible paving material. The bearing member separates the surface layers from the base layers and has about the same longitudinal and transverse dimensions as the surface layers. The bearing member is composed of a substantially aggregate-free or aggregate free material. The bearing member is sufficiently rigid to at least generally prevent any surface layers from conforming, during the useful life of the base layers, to irregularities of the base layers and to move with the surface layers as a unit in response to movement of the base layers.

BRIEF DESCRIPTION OF THE DRAWINGS

The above mentioned and other features and objects of this invention and the manner of attaining them will become more apparent and the invention itself will be better understood by reference to the following description of an embodiment of the invention taken in conjunction with the accompanying drawings, wherein.

DESCRIPTION OF A SPECIFIC EMBODIMENT

Figure 1:
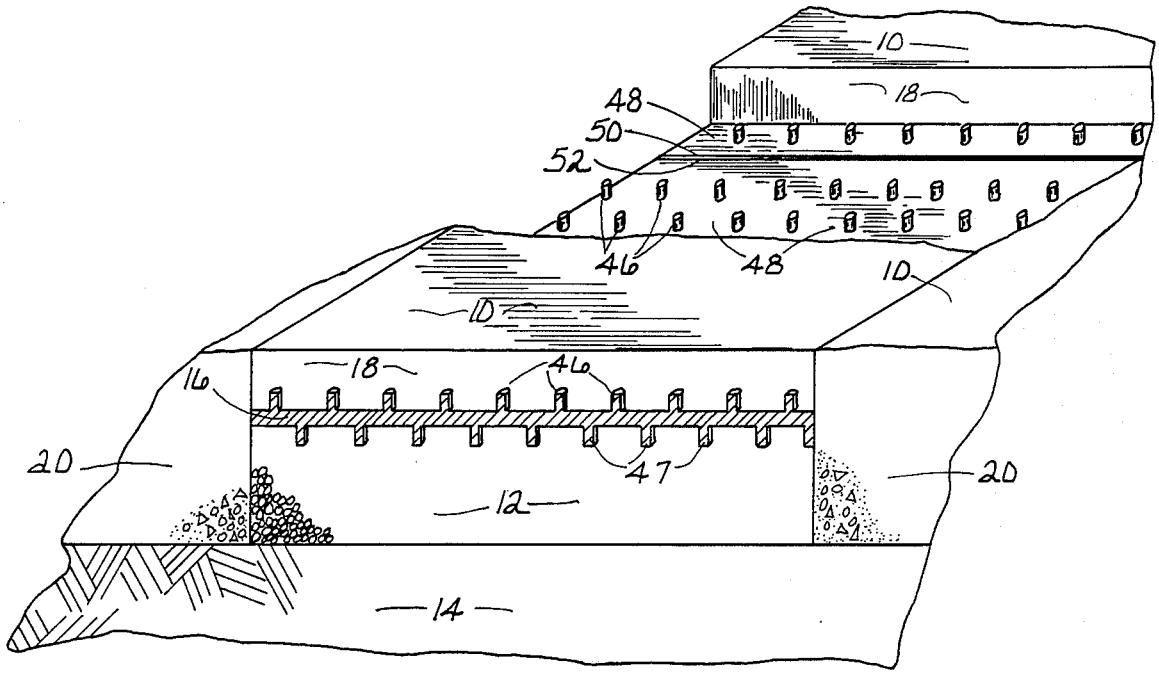
FIG. 1 is a perspective view of the pavement of the invention, cut away in the foreground to illustrate the cross-section of the invention and partially cut away in the background to illustrate internal features of the invention.

In the pavement 10 of the invention, one or more base layers 12 overlay a subgrade 14 and are themselves overlaid by a bearing member 16 and one or more surface layers 18. The pavement 10 of the invention may be bordered transversely by edges 20 incorporating shoulders or other features required by the design of a particular roadway.

Subgrade 14 and a base layer or layers 12 may be the same as in pavements other than the pavement 10 of the invention. Subgrade 14 could, for example, be tamped or treated in some other manner and base layers 12 could consist of a subbase layer 22 consisting of a relatively fine aggregate and a main base layer 24 of another material. In a specific embodiment of the invention, a base layer 12 may be worn concrete pavement. In that embodiment, base layers 12 may include a leveling layer 26 of paving material over main base layer 24. The leveling layer 26 may be discontinuous, filling in dips in the original pavement but not covering high spots. Surface layers 18 are preferably flexible paving materials and may include, for example, a primary surface layer 27 and a top coat layer 29.

Bearing member 16 which overlays base layers 12 is essentially coextensive, in the plane of the pavement 10, with surface layers 18. Bearing member 16 preferably has at least substantially planar upper surface 28 and planar lower surface 30. Bearing member 16 separates surface layers 18 from base layers 12 and in doing so, it is preferably that bearing member 16 be imperforate and impervious to water and paving materials in their liquid form.

Bearing member 16 is not a layer of concrete or bituminous or other aggregate-containing paving material. Bearing member 16 may be metal such as steel, or alternatively a polymeric material or composite. In a specific embodiment of the pavement 10 of the invention in which bearing member 16 is metal, the high thermal conductivity of the metal tends to equalize temperatures in pavement 10 to help reduce thermal warping due to a differential in temperatures between different portions of the pavement 10.

Whatever the material, bearing plate 16 is sufficiently rigid to prevent surface layers 18, if flexible, from conforming to various irregularities of base layers 12. In a specific embodiment of the invention, bearing member 16 prevents surface layers 18 from conforming to irregularities of base layers 12, which are insufficient to cause breakdown of the pavement 10 of the invention. "Breakdown" may be defined as a deterioration of the pavement sufficient to prevent or severely impair the use of the pavement for its intended purpose. A typical form of breakdown is, for example, settlement: a loss of elevation of a section of pavement accompanied by deformation or other damage resulting from a loss of integrity of the base of the pavement. Settlement may be accompanied by pumping, that is, expulsion of fluid mud or other material, up through cracks in the pavement or along edges of the pavement. Breakdown may also take the form of buckling, that is, an upthrust or breakout of pavement resulting from unrelieved expansion of the pavement. Breakdown of the pavement may also take the form of failure, a loss of integrity or continuity of a section of pavement, which may include the formation of holes in the pavement and/or migration of pavement debris. Breakdown renders a pavement unserviceable. Smaller irregularities or discontinuities do not render the pavement unserviceable, but, if occuring on the surface, increase the overall roughness of the pavement and may have a negative effect on the useful life of the pavement before breakdown occurs.

Bearing member 16 of the pavement 10 of the invention is capable of bridging discontinuities or irregularities in base layers 12, which are insufficient to render base layers 12 unserviceable as a base for flexible paving materials, absent bearing member 16. In other words, bearing member 16 can bridge irregularities, which in a pavement lacking bearing member 16 would result in the conforming of flexible surface layers to the irregularities and would result in an unsmooth but usable roadway surface. This allows base layers 12 to be worn concrete pavement, including a main base layer 24 of concrete including cracks 32 and joints 34.

Figure 2:
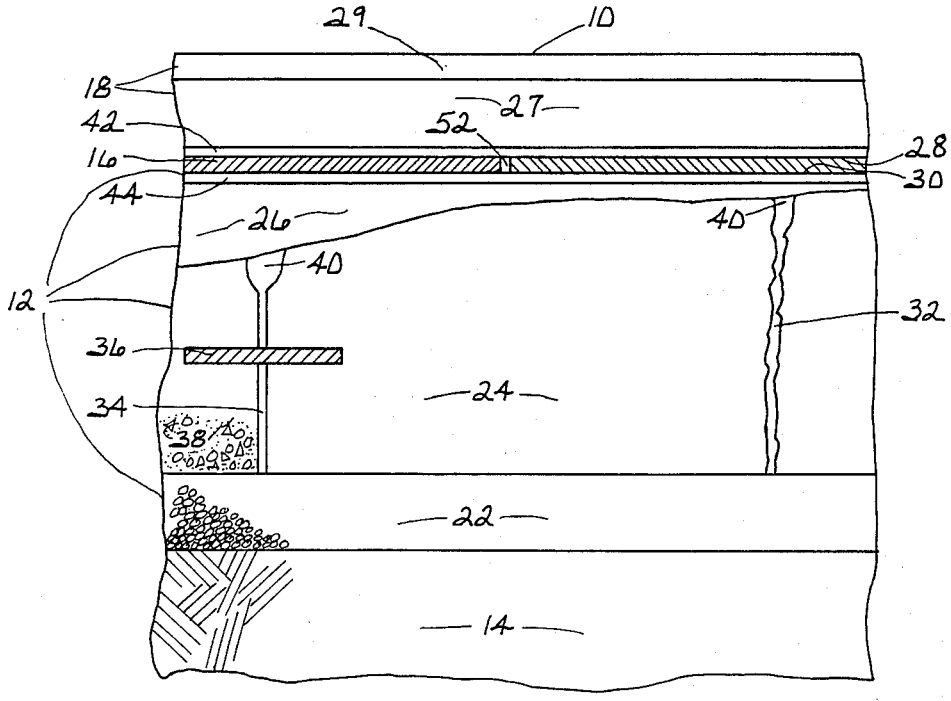
FIG. 2 is a longitudinal cross-sectional view of an alternate pavement of the invention.

In FIG. 2, a joint 34 is a transverse expansion joint including a rod 36 fixed at one end to the concrete 38 of main base layers 24, however, the worn concrete of main base layers 24 may also include other types of joints such as transverse contraction joints and longitudinal joints. Such joints 34 and cracks 32 may have a surface gap 40, which in worn pavement may or may not be filled with filler. In the pavement 10 of the invention, it is unimportant whether or not gaps 40 are filled with filler, since unfilled gaps will not over time cause an irregularity of surface layers 18. Because of this fact, a leveling layer 26, if used over the worn concrete main base layer 24, may be used discontinuously, that is, used only to level and not necessarily to fill in gaps 40.

Bearing member 16 may be attached to surface layers 18 and base layers 12 by various means such as, for example, upper and lower adhesive layers 42, 44 or stabilizers 46, 47 attached to bearing member 16 and extending out into one or more layers 12, 18.

As shown in FIG. 1, stabilizers 46 have a generally uniform geometry about a centerline extending generally perpendicularly from bearing member 16. Inherently, both adhesive layers 42, 44 and stabilizers 46 attach layers 12, 18 to bearing member 16 uniformly in both longitudinal and transverse directions. With or without stabilizers 46, bearing member 16 through each of the stabilizers 46 has relatively uniform upper and lower surfaces 28, 30.

Bearing member 16 may consist of a series of plates 48 joined together edge 50 to edge 50 to provide the a substantially continuous bearing member 16. In a specific embodiment of the invention, plates 48 are sheets of steel of an appropriate thickness to provide the gap-bridging capability required in a particular use, welded together edge 50 to edge 50. In some embodiments of the invention, bearing member 16 may include bearing member joints 52 which connect plates 48 to each other, and which may compensate for expansion and contraction of plates 48. In other embodiments of the invention, bearing member 16 may be formed of plastic material having similar physical properties of sheet metal with an expansivity about the same as the paving materials of base layers 12 and/or surface layers 18.

In operation of a specific embodiment of the invention, bearing member 16 is more resistant to shearing stress than base layers 12 and surface layers 18. Bearing member 16 tends to spread the force of vehicle loads reducing the chance of damage to base layers 12. This means that wear or damage to surface layers 18 tends to be arrested by bearing member 16 before the damage can spread to base layers 12. For example, a pothole would not tend to deepen beyond bearing member 16 under the action of traffic. This permits easier scheduling of maintenance. Bearing member 16 similarly spreads stresses resulting from discontinuities or weaknesses in base layers 12 to help prevent any further degradation of base layers 12 or damage to surface layers 18. Bearing member 16 may also serve to prevent catastrophic breakdowns of pavement, by deforming over breakdowns in base layers 12 under the action of vehicle loads, rather than abruptly breaking down in concert with base layers 12. In the method of producing pavement 10 of the invention, one or more base layers 12 are provided; if the base is worn concrete, breakdowns of the pavement must first be repaired. One or more plates 48 are installed on base layers 12 and joined edge 50 to edge 50 sequentially to provide bearing member 16. If plates 48 are metal, they may be welded together. One or more surface layers 18 may then be placed over bearing member 16.

The pavement 10 of the invention may be resurfaced by first exposing a portion of bearing member 16 so that bearing member 16 can be engaged by a paving material removing mechanism which provides for removal of a portion of a bituminous paving material layer as the mechanism passes over it. This type of mechanism is commonly used in resurfacing bituminous pavements. The mechanism may then move along bearing member 16, using a portion of the mechanism riding on bearing member 16 to guide the depth of paving material removed by the mechanism. This prevents uneven places in the existing pavement 10 from offsetting the depth of cut of the mechanism and eliminates the need to patch such places prior to use of the mechanism. Bearing member 16 also serves to protect base layers 12 from the action of the mechanism. After the removal of surface layers 18 has been completed new surface layers 18 may be reapplied.

The invention as above-described provides an improved pavement and improved methods for producing and resurfacing pavement in which the flexible surface layers of paving material will not conform over time to irregularities in the underlining base layer. The surface layers are separated from the base layers by a rigid bearing member which moves with the surface layers as a unit in response to movement of the base layers and prevents the surface layers from conforming over time to irregularities in the underlying base layers.

While a specific embodiment of the invention has been shown and described herein for the purposes of illustration, the protection afforded by any patent which may issue upon this application is not limited strictly to the disclosed embodiment, but extends to all structures and arrangements which contain the essence of the invention, and which fall fairly within the scope of the claims, which are appended hereto:

What is claimed is:

1. A pavement comprising a pair of base layers superimposed upon a subgrade, said base layers being a worn pavement layer and a leveling layer discontinuously superimposed on said worn pavement layer, one or more surface layers overlaying said base layers, said surface layers being composed of flexible paving materials, a planar bearing member interposed between said base layers and said surface layers, said bearing member being substantially imperforate, said bearing member separating said surface layers from said base layers, said bearing member having about the same longitudinal and transverse dimensions as said surface layers, said bearing member being sufficiently rigid to at least generally prevent said surface layers from conforming, during useful life of said base layers, to irregularities of said base layers, and means a plurality of fastening for uniformly fastening said bearing member to said base layers and said surface layers in both longitudinal and transverse directions, each of said fastening means generally having a uniform geometry about center lines extending from said bearing member through each of said fastening means, said surface layers and said worn pavement having interposed between them only said bearing member, said means for fastening, and said discontinuous leveling layer.

2. The pavement of claim 1 wherein said means for fastening further comprises one or more layers of adhesive.

3. The pavement of claim 1 wherein said means for fastening further comprises a first plurality of stabilizers attached to said bearing member and extending into one or more of said surface layers and a second plurality of stabilizers attached to said bearing member and extending into one or more of said base layers.

4. The pavement of claim 1 wherein said bearing member is capable of deforming, without failure, under a shearing stress applied to said bearing member sufficient to cause failure of said base layers, if applied to said base layers.

5. A pavement comprising one or more base layers disposed on a subgrade, said base layers being composed of paving materials, one or more surface layers overlaying said base layers, said surface layers being composed of flexible paving materials, a planar bearing member being interposed between said base layers and said surface layers, said bearing member separating said surface layers from said base layers, said bearing member having generally the same longitudinal and transverse dimensions as said surface layers, said bearing member being composed of at least substantially aggregate free material, said bearing member being substantially continuous in both the longitudinal and transverse directions, said bearing member being sufficiently rigid to at least generally prevent said surface layers from conforming, during the useful life of said base layers, to irregularities of said base layers, said bearing member being substantially imperforate, a first plurality of stabilizers attached to said bearing member, said first plurality of stabilizers extending into one or more of said surface layers, and a second plurality of stabilizers attached to said bearing member, said second plurality of stabilizers extending into one or more of said base layers, each of said stabilizers generally having a uniform geometry about center lines extending generally perpendicularly from said planar bearing member and through each of said stabilizers, said stabilizers being arranged in a pattern which is uniform both in the longitudinal and transverse directions, whereby said bearing member is engaged with said surface and base layers uniformly in both longitudinal and transverse directions.

6. The pavement of claim 5 wherein said bearing member is capable of deforming, without failure, under a shearing stress applied to said bearing member sufficient to cause failure of said base layers, if applied to said base layers.

7. The pavement of claim 5 wherein said bearing member has about the same expansivity as one or more of said layers of paving material.

8. The pavement of claim 5 wherein said bearing member further comprises one or more plates joined together.

9. The pavement of claim 5 wherein said base layers further comprise worn concrete pavement.

10. The pavement of claim 9 wherein joints and cracks in said worn concrete pavement are unfilled.

11. The pavement of claim 9 wherein said base layers further comprise a leveling layer superimposed on said worn concrete pavement, said leveling layer being composed of flexible paving material.

12. The pavement of claim 9 wherein said base layers further comprise a leveling layer superimposed on said worn concrete pavement, said leveling layer being discontinuous.

13. A pavement comprising one or more base layers of paving materials overlaying a subgrade, each of said base layers having discontinuities insufficient to render said base layers unserviceable as support for paving materials conforming to said base layers, one or more surface layers overlaying said base layers, a bearing member interposed between said base layers and said surface layers separating said surface layers from said base layers, said bearing member having generally the same longitudinal and transverse dimensions as said surface layers, said bearing member being composed of at least substantially aggregate free material, said bearing member being non-bituminous and non-concretionary, said bearing member being at least substantially continuous in a transverse direction, said bearing member being at least substantially continuous in a longitudinal direction, said bearing member being capable of bridging said discontinuities under vehicle loads without substantial non-resilient deformation, said bearing member being substantially imperforate, a first plurality of stabilizers attached to said bearing member, said first plurality of stabilizers extending into one or ore of said surface layers, and a second plurality of stabilizers attached to said bearing member, said second plurality of stabilizers extending into one or more of said base layers, each of said stabilizers generally having a uniform geometry about center lines extending generally perpendicularly from said bearing member and through each of said stabilizers, said stabilizers being arranged in a pattern which is uniform both in the longitudinal and transverse directions, whereby said bearing member is engaged with said surface and base layers uniformly in both longitudinal and transverse directions.

14. The pavement of claim 13 wherein said bearing member further comprises one or more plates of substantially rigid material, said plates each having a plurality of edges, said plates being joined to each other edge to edge.

15. The pavement of claim 13 wherein said base layers further comprise worn concrete pavement.

16. The pavement of claim 13 wherein said base layers further comprise a leveling layer superimposed on said worn concrete pavement, said leveling layer being composed of flexible paving material.

* * * * *